US005407346A

United States Patent [19]

Sher

[11] Patent Number: 5,407,346

[45] Date of Patent: Apr. 18, 1995

[54] PUSH TYPE SAFETY LOCK LIGHTER

[75] Inventor: Tak C. Sher, North Point, Hong Kong

[73] Assignees: Polycity Industrial Ltd.; Tak Fi International (Holdings) Ltd., both of Hong Kong

[21] Appl. No.: 226,020

[22] Filed: Apr. 11, 1994

[51] Int. Cl.[6] ..... F23D 11/36

[52] U.S. Cl. ..... 431/153; 431/276

[58] Field of Search ..... 431/153, 276, 277

[56] References Cited

U.S. PATENT DOCUMENTS

| | | | |
|---|---|---|---|
| 5,074,781 | 12/1991 | Fujita | 431/277 X |
| 5,090,893 | 2/1992 | Floriot | 431/153 |
| 5,092,764 | 3/1992 | McDonough et al. | 431/277 |
| 5,125,829 | 6/1992 | McDonough et al. | 431/153 |
| 5,165,885 | 11/1992 | Iwahori | 431/153 |
| 5,197,870 | 3/1993 | Yang | 431/153 |
| 5,213,495 | 5/1993 | Pan | 431/344 |
| 5,215,458 | 6/1993 | Cirami | 431/277 |
| 5,224,854 | 6/1993 | Ansquer | 431/277 X |
| 5,271,731 | 12/1993 | Hsin-Chung | 431/254 |

FOREIGN PATENT DOCUMENTS

| | | | |
|---|---|---|---|
| 0296281 | 12/1988 | European Pat. Off. | 431/153 |

*Primary Examiner*—Carroll B. Dority
*Attorney, Agent, or Firm*—Ladas & Parry

[57] ABSTRACT

A safety lighter is disclosed. The lighter comprises a lighter body, a nozzle, a mounting frame disposed on the lighter body, and an actuating lever which is pivotally mounted on the mounting frame. The front end of the lever grips the nozzle and moves it from its lower position, where gas cannot escape from said nozzle, to the nozzle's upper position where gas is ejected from said nozzle when the rear end of the lever is depressed. The rear end of the lever has a downwardly extending leg. A sliding member is reciprocatingly mounted on the lighter body between a first position in which the rear end of the lever cannot be depressed because the leg contacts the sliding member and a second position in which an inclined surface leading to a hole in the sliding member is located below the leg. When the sliding member is in the second position and the rear end of the lever is depressed, the leg engages the inclined surface and pushes the sliding member downward and backward until the leg can travel into the hole. At that point the front end of the lever pivots upward and the nozzle is raised to it supper position.

3 Claims, 5 Drawing Sheets

PUSH TYPE SAFETY LOCK LIGHTER

BACKGROUND OF THE INVENTION

This invention relates to the field of lighters, such as cigarette lighters.

Modern butane lighters have become very popular. One of the reasons for their popularity is that the height of the flame produced by the lighter can be varied over a wide range by varying the amount of fuel allowed to be ejected from the lighter. The very feature which makes such lighters attractive to the users also makes such lighters dangerous if they are accidentally ignited. When the lighter produces a flame in an uncontrolled circumstance, particularly when the lighter is set on its high setting, materials (such as curtains, clothing, hair) may accidentally be lit on fire. Also modern butane lighters suffer from the potential that the lever which actuates the lighter's nozzle will accidentally be depressed, thereby causing an unintended ejection of fuel, and therefore loss of fuel stored within the lighter body.

The invention disclosed herein significantly reduces the risk that the foregoing problems will be incurred by the provision of a safety lock feature which prevents the lighter's nozzle from begin put into the actuated position unless the user deliberately puts the lighter in an operational condition. In a preferred embodiment of the invention, the safety lock mechanism of the invention is automatically engaged.

SUMMARY OF THE INVENTION

Conventional lighters comprise a lighter body within which is housed a reservoir containing butane or other suitable fuel, a mounting frame affixed atop the lighter body, a nozzle inserted through the mounting frame into connected relationship with the reservoir, a lever for actuating the nozzle, and an igniter such as a striker, flint, and flint spring combination, which igniter is positioned close to the rear end of the lever so that the igniter and the rear end of the lever may be actuated nearly simultaneously. When this occurs a flame is caused to be ignited from the head of the nozzle through which fuel is being ejected while the rear end of the lever is being held down.

A sliding member is reciprocatingly mounted on the lighter body between a first position in which the rear end of the lever cannot be depressed because the leg contacts the sliding member and a second position in which an inclined surface leading to a hole in the sliding member is located below the leg. When the sliding member is in the second position and the rear end of the lever is depressed, the leg engages the inclined surface and pushes the sliding member downward and backward until the leg can travel into the hole. At that point the front end of the lever pivots upward and the nozzle is raised to it supper position.

DETAILED DESCRIPTION OF THE INVENTION

Figure 1:
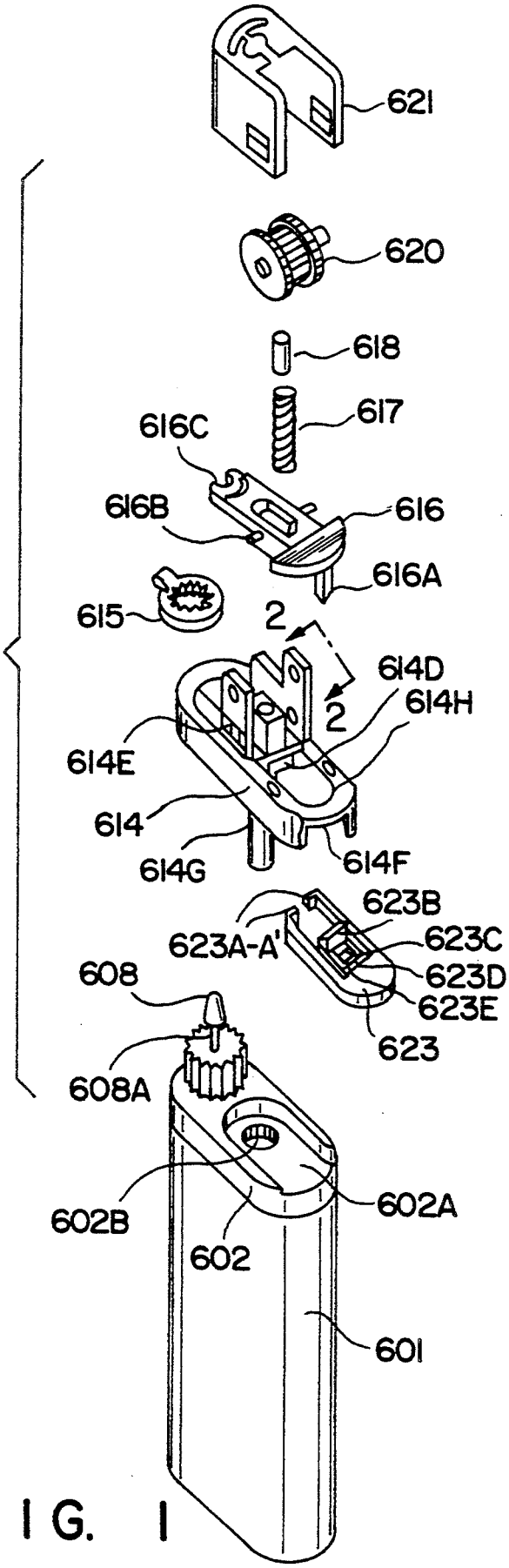
FIG. 1 is an exploded view of the safety lock lighter of the present invention.

The preferred embodiment of the invention is illustrated in the attached drawings which are referred to herein. The same reference numeral will be used to identify identical elements throughout the drawings.

FIG. 1 illustrates components commonly mounted on a lighter body 601 in which lighter fuel is contained. Such components include nozzle 608 having a head and downwardly extending tube 608A disposed toward the front of the lighter body, mounting frame 614, flame adjustment wheel 615, the igniter comprising flint spring 617, flint 618 and striker 620, nozzle actuating lever 616, and a windshield 621. Nozzle tube 608A is connected in communicating relationship with the interior of the lighter body where fuel is stored. When the nozzle is in its raised position, fuel can be ejected from it. When the nozzle is in its lower position, fuel cannot be ejected from it.

Illustrated in FIGS. 1, 2, 9 and 10 are elements forming a safety means of the present invention. These include recessed area 602A which is formed in the top surface 602 of the lighter body 601; opening 614F in the mounting frame 614 adjacent the rear of the lighter body; leg 616A of the nozzle actuating lever 616; cam 614G which extends vertically downward from the underside of the mounting frame 614, and slider 623.

Figure 3:
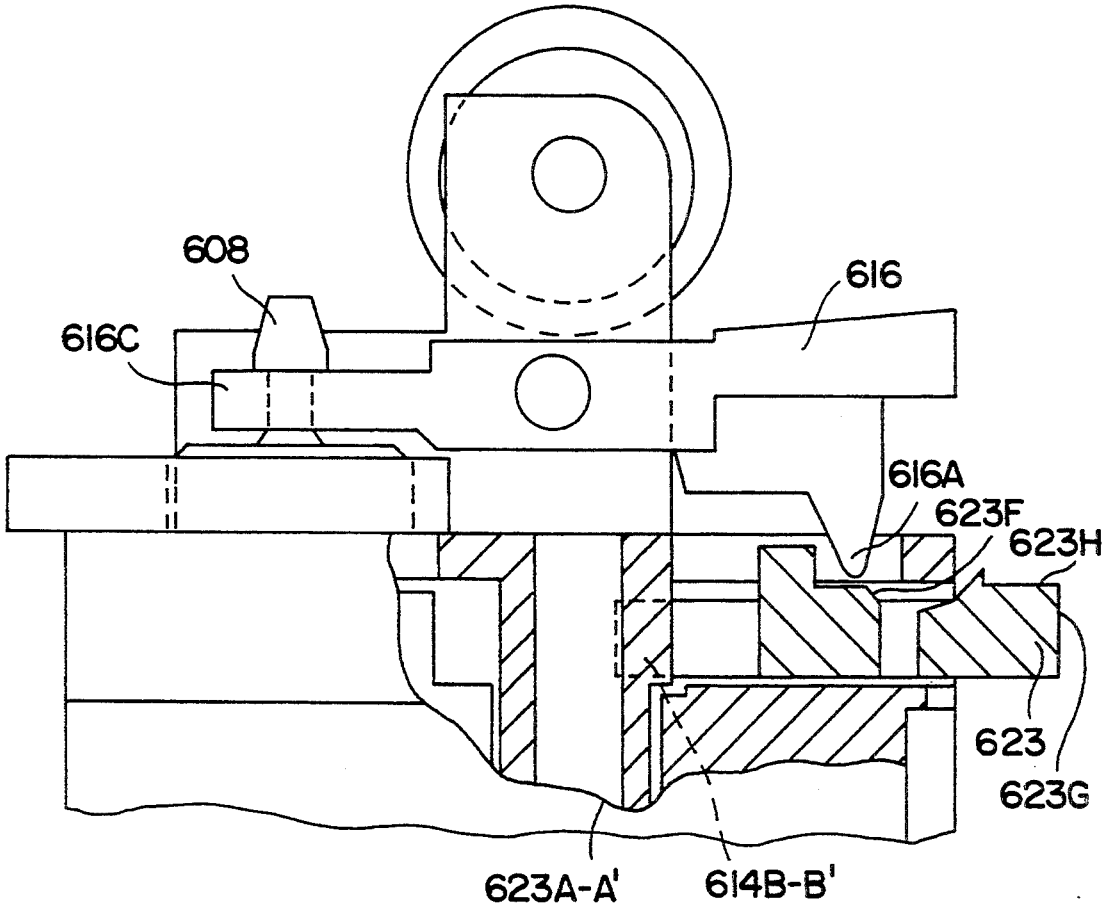
FIG. 3 is a partial side elevational view of the lighter of the present invention, partially broken away and sectioned, illustrating the lighter of the present invention in its safety locked position, with the lighter's wind shield removed.
Figure 4:
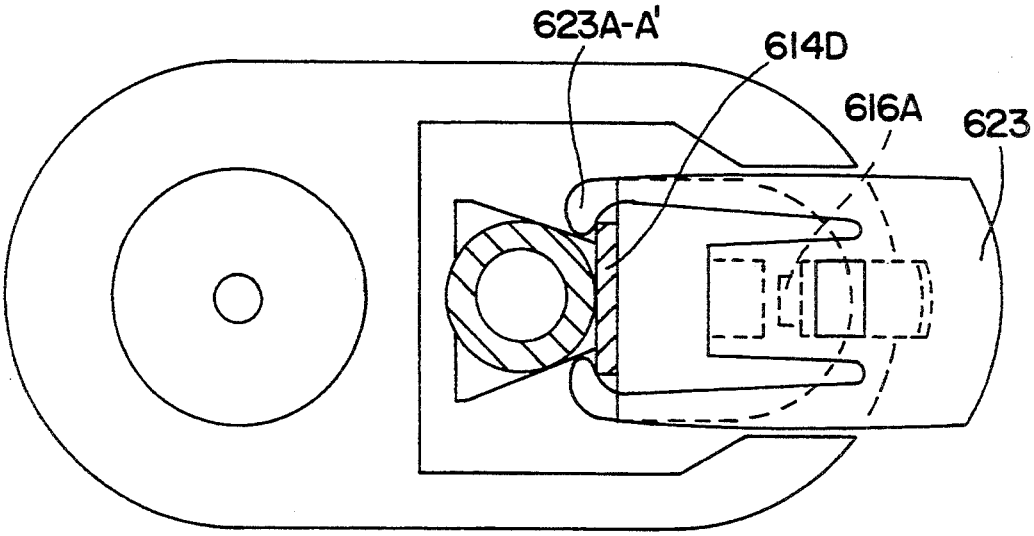
FIG. 4 is a partial sectioned top view of the lighter of the present invention, with some parts removed, illustrating the lighter in its safety locked condition.

The slider is fitted on top of the lighter body in the space defined by recess 602A, and the mounting frame 614 is disposed on top of the lighter body and the slider such that the posterior end 623G of the slider plate 623H extends through the opening 614F in the mounting frame 614 beyond the rear of the lighter body 601 when the lighter is in the safety locked position as shown in FIG. 3 and 4. Slider 623 reciprocates back and forth between the safety locked position illustrated in FIGS. 3 and 4 and the lighter operational position illustrated in FIGS. 5 and 6.

The slider is moved from the safety position to the operational position by pulling the slider backward by hand. The slider is moved back to the safety position either by pushing the slider forward by hand or automatically upon the igniting of a flame as described further below.

Excessive travel of the slider 623 in the forward direction is restricted by means of the upstanding protrusion 623B, extending upward from the anterior end of slider plate 623H, and the stopper 614B on the mounting frame as illustrated in FIGS. 1, 2, 3 and 9. Excessive backward movement of the slider is prevented by resilient fingers 623A-A' which extend forward from the anterior end of slider plate 623H. When the slider is pulled backwards the resilient fingers 623A-A' grasp onto the forward side of the stopper 614B, as shown in FIG. 4.

Figure 2:
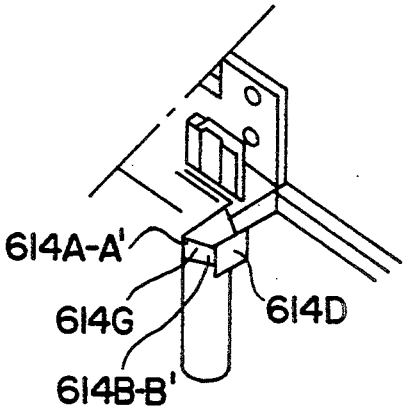
FIG. 2 is a magnified view of a portion of the lighter of the present invention, partially broken away, illustrating that portion of the invented safety lock lighter indicated by line 2—2 of FIG. 1.
Figure 9:
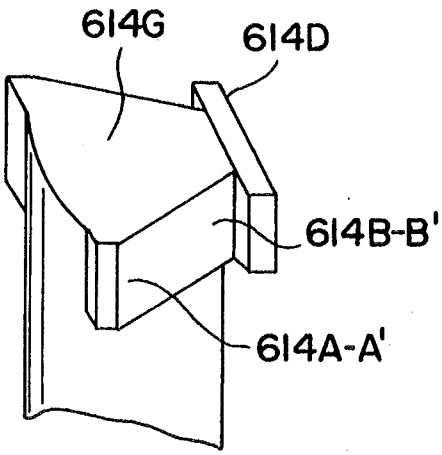
FIG. 9 is a perspective view of the cam element of the invention.

The slider is releasably maintained in the safety locked position by virtue of the relationship of the resilient fingers 623A-A' with cam 614G. As shown in FIGS. 2 and 4 and 9, cam 614G is a cylindrical projection which extends downwardly from the underside of the mounting frame 614. The bottom end of the cam fits within a cylindrical opening 602B formed in the upper part of the lighter body. The upper end of the cam has a generally triangular shape with its base disposed toward the front of the lighter body and what would be its apex disposed toward the rear of the lighter body. It is at what would be the apex of the upper end of the cam that stopper 614 is disposed. (Note that the center entire cam could have the same shape as its upper end, and opening 602B would be shaped accordingly.) When the slider is in the safety locked position, resilient fingers 623A-A' are located on the rearward cam spots 614B-B'. When the user of the lighter desires to put the slider in the operational position, the user pushes forward on the rear end 623G of the plate with sufficient force to cause the resilient fingers 623A-A' to spread open as they travel forward along the sides of the triangular upper portion of the cam. As the user continues to push the slider forward, upstanding protrusion 623D slides under edge 614H of the mounting frame and the back side of protrusion 623D locks into abutting relationship with the back edge 614H of the mounting frame. At this point the slider remains in the lighter operational position as shown in FIGS. 5 and 6.

When the slider is in the safety locked position as shown in FIGS. 3 and 4, leg 616A, which extends downward from the rear portion of the nozzle actuating lever 616, is positioned directly above the plate 623H of the slider 623. As a result, the downward movement of the rear end of the nozzle actuating lever is restricted and its front end cannot be moved up. Because the front end of the nozzle actuating lever cannot be pulled up, the nozzle itself remains in the lower position and fuel cannot be ejected from the lighter body.

Figure 5:
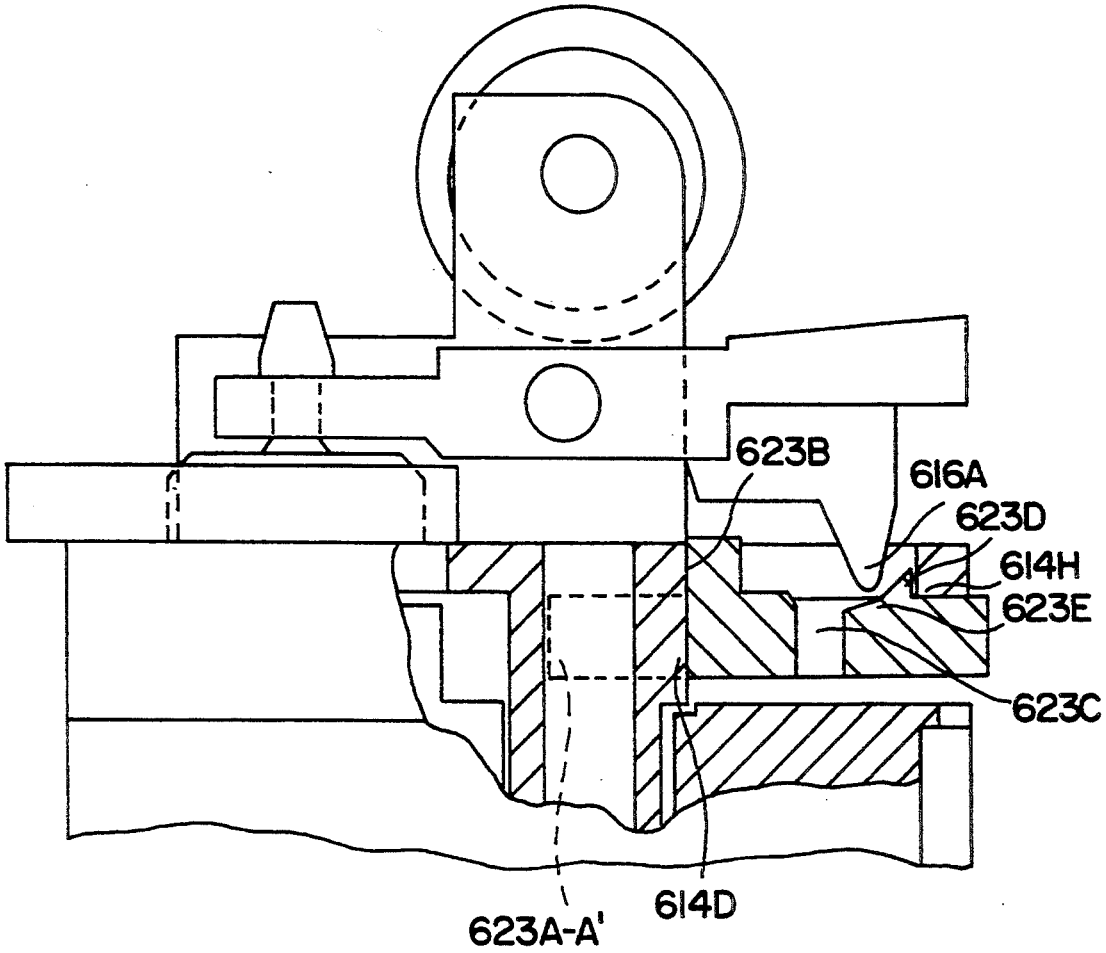
FIG. 5 is a partial side elevational view of the lighter of the present invention, partially broken away and sectioned, illustrating the lighter in its operation condition, with the lighter's wind shield removed.
Figure 6:
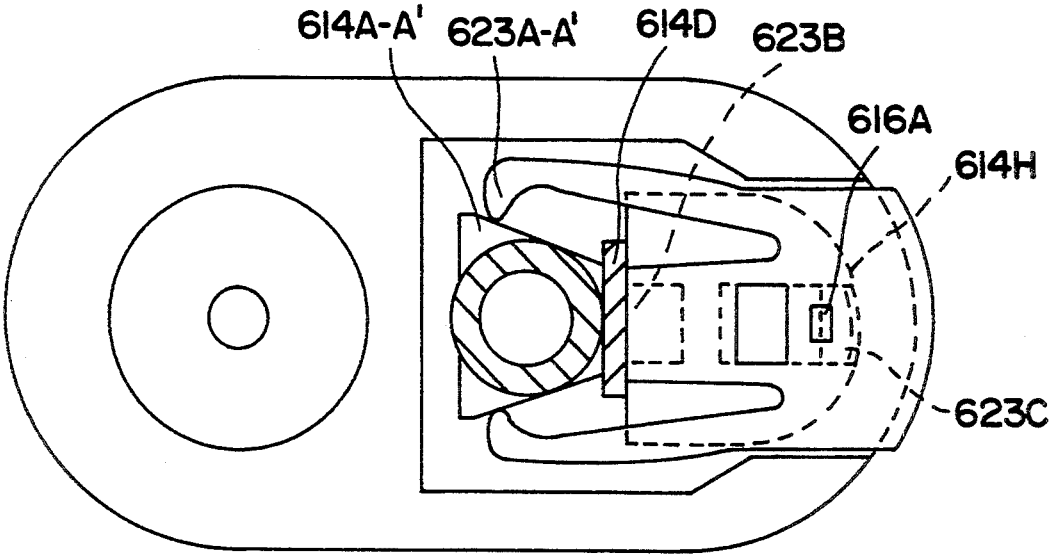
FIG. 6 is a partially sectional top view of the lighter of the present invention, with some parts removed, illustrating the lighter in its operational condition.

FIGS. 5 and 6 illustrate the lighter with the slider pushed forward to the operation position. At this moment, fingers 623A-A' of the slider have been moved to the outer cam spot 614A-A' of the cam 614G of the mounting frame 614. Also at this point, the slider cannot be moved further forward due to the fact that forward protrusion 623B of the slider has come into abutting relationship with the stopper 614D of the mounting frame. As mentioned just above, the fingers 623A-A' have been spread wide; this causes the creation of a force tending to urge the slider backward toward the safety locked position. This is due to the resilient force inherent in the fingers. This rearward movement is stopped by the engagement of rear protrusion 623D with the inside surface of rear edge 614H of the mounting frame 614.

Figure 7:
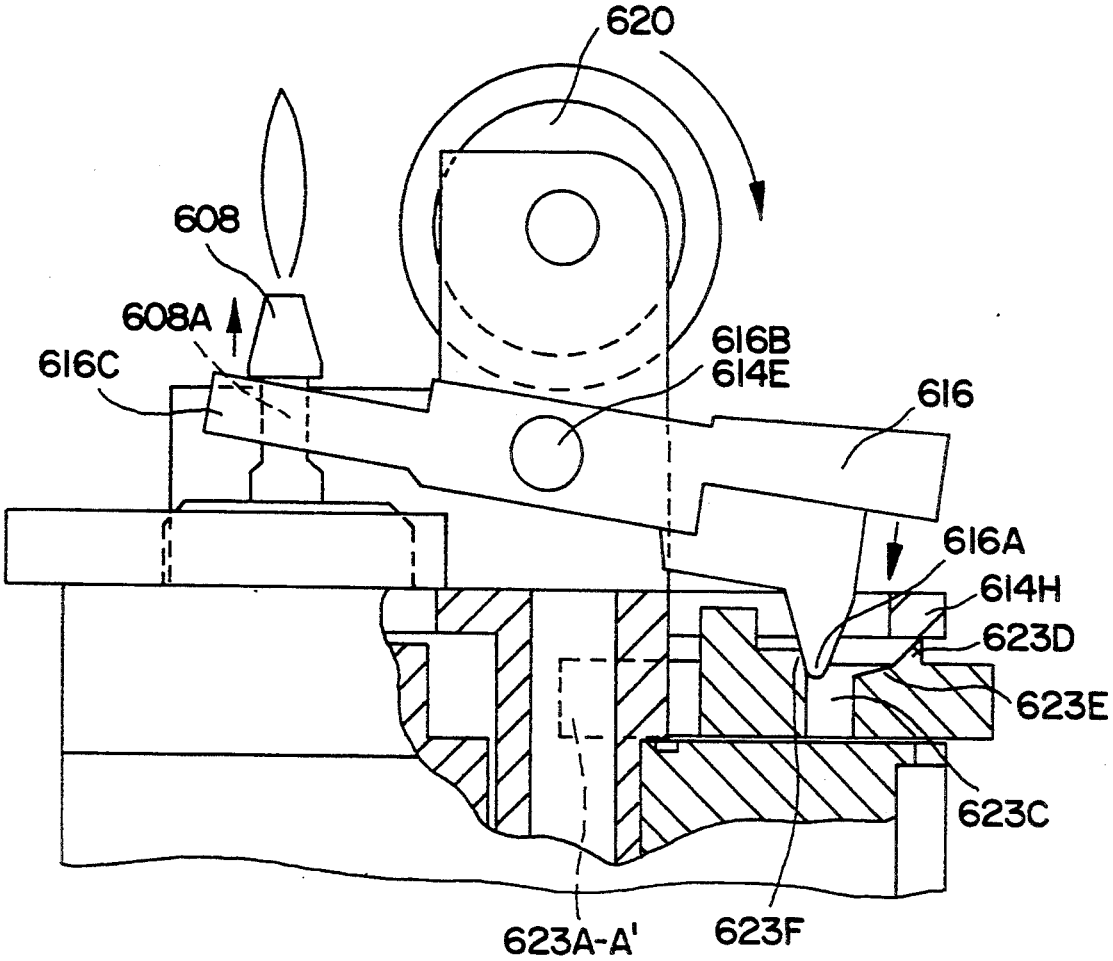
FIG. 7 is a partial side elevational view of the lighter of the present invention, partially broken away and sectioned, illustrating the lighter of the present invention in its operational condition and with its nozzle actuating lever in its actuated position, with the lighter's wind shield removed.
Figure 8:
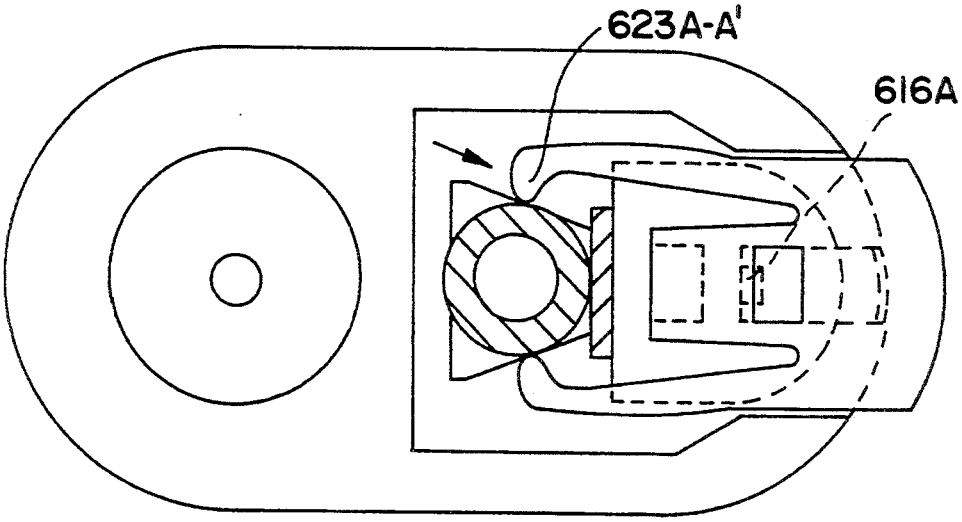
FIG. 8 is a partially sectioned top view of the lighter of the present invention, with some parts removed, illustrating the lighter in its operational condition and with its nozzle actuating lever depressed.
Figure 10:
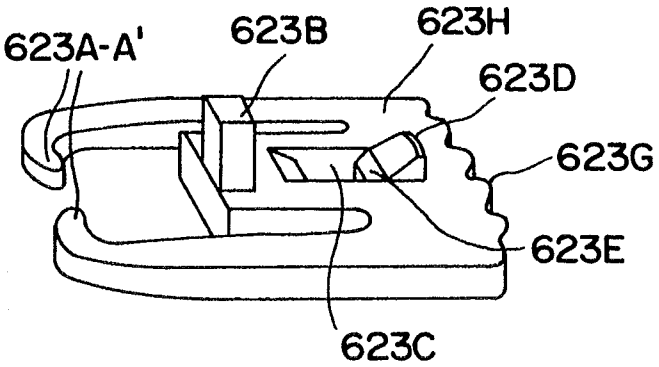
FIG. 10 is a perspective view of the slider element of the invention.

With the slider in the operational position shown in FIGS. 5 and 6, leg 616A is positioned above rear inclined surface 623E. As the rear end of nozzle actuating lever is depressed, the bottom of leg 616A pushes down against rear inclined surface 623E. This causes the slider to be urged downward and backward until protrusion 623D breaks away from engagement with the inside surface of rear edge 614H. As the slider moves rearward and the leg 616A continues in its arc downward and forward, leg 616A becomes positioned over hole 623C in the plate of the slider 623. As a result, as illustrated on FIGS. 7 and 8, the rear end of nozzle actuating lever 616 is able to be depressed sufficiently far downward that the front end of the lever is able to pull the nozzle up into its actuated position so that fuel can be ejected into the head of the nozzle.

As the rear end of lever 616 is depressed downward, striker wheel 620 is actuated by the user of the lighter to strike the flint 618 to generate a spark. This spark ignites the fuel being ejected from the nozzle head to light a flame. The striker wheel 620 stops immediately after the lighting of the flame while the ejection of gas and the flame are maintained during the period that the rear end of the lever is held down.

The front and rear surfaces of leg 616A are tapered to a rounded point, and plate 623 is provided with a forward inclined surface 623F. This allows for the rear end of the lever to have maximum downward movement without having to make hole 623C very large. It also allows for the leg 616A to hold the slider in place against a rearward restoring force being exerted by leg 623A-A', without the leg and the slider doing damage to each other.

When the user's finger is removed from the rear end of nozzle actuating lever 616, leg 616A of lever 616 retreats from hole 623C as the rear end of the nozzle actuating lever rises. The front end of the lever falls bringing downward the nozzle, which cuts off the supply of fuel and extinguishes the flame. During this time, fingers 623A-A' under the effect of the restorative elastic force inherent in them, close and cause the slider to be moved backward until fingers 623A-A' reach cam spots 614B-B' at the rear of the cam 614G, and just in front of stopper 614D. Inwardly curved fingers 623A-A' grip onto the forward surface of the stopper thereby preventing further rearward movement of the slider.

Slider 623 may be made of a metallic material. However in the preferred embodiment, slider 623 is made of a resilient plastic material. To aide in the movement of the fingers over the contour of the cam, the resilient fingers are provided with rounded corners.

Above there has been described a unique safety lock lighter. It should be understood that various changes of the details, materials, arrangements of parts and uses which have been herein described and illustrated in order to explain the nature of the invention will occur to and may be made by those skilled in the art upon the reading of this disclosure, and such changes are intended to be included within the principles and scope of this invention.

I claim:

1. A lighter comprising, a lighter body containing fuel in its interior, said lighter body having a front and a rear and a top surface extending from said front to said rear, said top surface having a recess formed therein which extends from the rear toward said front of said lighter body beyond a point midway between said front and rear, said recess having an opening formed therein and extending downward in the direction of the bottom of said lighter body;

a nozzle disposed in communicating relationship with the lighter body's interior and comprising a head extending above the lighter body, said nozzle reciprocatingly mounted upon said lighter body between a lower position and an upper position, said nozzle being configured so that fuel stored in said interior of said lighter body may be ejected from said nozzle head when said nozzle is in the upper position, and when said nozzle is in said lower position fuel cannot be ejected from said nozzle head;

a mounting frame disposed atop said lighter body, said mounting frame having a cam member extending into said opening;

a nozzle actuating lever having a front end and a rear end and a fulcrum disposed intermediate said front and rear ends, said lever having at its front end a gripper engaging said nozzle, said lever being pivotally mounted upon said mounting frame; said lever having a leg extending downward from the rear end of said lever;

a slider formed of a plate having an anterior end and a posterior end, a pair of resilient finger members extending forward from the anterior end of said plate, a first protrusion extending upward from and adjacent to the posterior end of said plate, said plate having a hole formed therein in front of said first protrusion, an inclined surface positioned behind said hole and sloping downward toward said hole, said slider being reciprocatingly mounted in said recess in the top surface of said lighter body between first and second positions, wherein, when said slider is in said first position said finger members are in contact with a portion of said cam such that said finger members are in a relaxed state, and said plate is positioned below said leg such that if said rear end of said lever is urged downward said leg comes is contact with said plate such that the downward movement of the rear end of said lever is prevented and the front end of said lever does not pivot upward to pull said nozzle into its upper position, and wherein, when said slider is in said second position said fingers are in contact with a portion of said cam such that said finger members are in a state of tension such that they exert a force tending to move said slider back to said first position, said first protrusion is in a locked relationship with said mounting frame to resist the force exerted by said fingers tending to urge the slider toward said first position, and said inclined surface is positioned below said leg such that if said rear end of said lever is urged downward, said leg contacts said inclined surface and forces said slider to move such that said first protrusion is freed from the locked relationship with said mounting frame and said slider begins to move back toward said first position, and in doing so causes said hole to be positioned under leg such that the rear end of the lever is allowed to move downward with the front end of said lever pivoting upward and pulling the nozzle from its lower position to its upper position.

2. The lighter of claim 1 wherein said mounting frame further comprises a stop having a front side and a rear side, said stop being positioned rearward of said cam, and wherein said slider further comprises a second protrusion extending upward from and adjacent to the anterior end of said plate such that when said slider is in said second position said second protrusion comes into abutting relationship with the rear side of said stop, and when said slider is in said first position said fingers come into abutting relationship with the front side of said stop.

3. The lighter of claim 2 wherein the said leg is tapered.

* * * * *